US009850085B2

(12) United States Patent
Türke et al.

(10) Patent No.: US 9,850,085 B2
(45) Date of Patent: Dec. 26, 2017

(54) SHEET NUMBERING PROCESS AND SHEET-PROCESSING MACHINE FOR CARRYING OUT THE SAME

(71) Applicant: KBA-NOTASYS SA, Lausanne (CH)

(72) Inventors: Thomas Türke, Lonay (CH); Matthias Gygi, Schmitten (CH)

(73) Assignee: KBA-NotaSys SA, Lausanne (CH)

( * ) Notice: Subject to any disclaimer, the term of this patent is extended or adjusted under 35 U.S.C. 154(b) by 112 days.

(21) Appl. No.: 14/769,345

(22) PCT Filed: Feb. 26, 2014

(86) PCT No.: PCT/IB2014/059271

§ 371 (c)(1),
(2) Date: Aug. 20, 2015

(87) PCT Pub. No.: WO2014/132206

PCT Pub. Date: Sep. 4, 2014

(65) Prior Publication Data

US 2016/0016744 A1 Jan. 21, 2016

(30) Foreign Application Priority Data

Feb. 28, 2013 (EP) ..... 13157342

(51) Int. Cl.
*B65H 7/20* (2006.01)
*B41F 33/00* (2006.01)
(Continued)

(52) U.S. Cl.
CPC ..... *B65H 7/20* (2013.01); *B41F 11/02* (2013.01); *B41F 33/009* (2013.01); *B65H 33/16* (2013.01);
(Continued)

(58) Field of Classification Search
CPC ..... B65H 7/20; B65H 33/16; B65H 39/02; B65H 43/04; B65H 43/06; B41F 11/02; B41F 33/009; G07D 7/18
(Continued)

(56) References Cited

U.S. PATENT DOCUMENTS 4,677,910 A * 7/1987 Kuhfuss ..... B41F 11/02 101/93.01
5,590,507 A * 1/1997 Wyssmann ..... B41F 33/009 53/399
(Continued)

FOREIGN PATENT DOCUMENTS

EP 0 718 112 6/1996
EP 1 808 391 7/2007
(Continued)

OTHER PUBLICATIONS

International Search Report for PCT/IB2014/059271, dated Jul. 7, 2014, 3 pages.
(Continued)

*Primary Examiner* — Patrick H Mackey
(74) *Attorney, Agent, or Firm* — Nixon & Vanderhye P.C.

(57) ABSTRACT

There is described a sheet numbering process involving feeding of individual sheets (S) in succession, which individual sheets (S) each carry a plurality of imprints (P) that are arranged in a matrix of rows and columns, and providing unique serial numbers to multiple ones of the plurality of imprints (P) carried by the individual sheets (S). The sheet numbering process comprises numbering of at least some of the individual sheets (S), wherein numbering of the individual sheets (S) is selectively commutable between a first numbering scheme (N1) and at least a second numbering scheme (N2; N2'; N*), different from the first numbering scheme (N1), without interruption of the numbering process. The first numbering scheme (N1) involves providing all
(Continued)

imprints (P) of a first subset ($S^0$) of individual sheets (S) with a unique serial number (SN1) of the first numbering scheme (N1). The second numbering scheme (N2; N2'; N*) involves providing all or part of the imprints (P) of a second subset (S'; S*) of individual sheets (S) with a unique serial number (SN2; SN2'; SN*) of the second numbering scheme (N2; N2'; N*). The first subset ($S^0$) of individual sheets (S) and the second subset (S'; S*) of individual sheets are sorted after numbering in dependence of the numbering scheme (N1; N2; N2'; N*). Also described is a sheet-processing machine for carrying out the aforementioned sheet numbering process.

22 Claims, 10 Drawing Sheets

(51) Int. Cl.

| | |
|---|---|
| ***B41F 11/02*** | (2006.01) |
| ***B65H 33/16*** | (2006.01) |
| ***B65H 39/02*** | (2006.01) |
| ***B65H 43/04*** | (2006.01) |
| ***B65H 43/06*** | (2006.01) |
| ***G07D 7/181*** | (2016.01) |

(52) U.S. Cl.
CPC ..... *B65H 39/02* (2013.01); *B65H 43/04* (2013.01); *B65H 43/06* (2013.01); *G07D 7/181* (2017.05)

(58) Field of Classification Search
USPC ..... 270/58.01; 209/10, 534, 552, 576; 194/206, 207; 382/112, 135
See application file for complete search history.

(56) References Cited

U.S. PATENT DOCUMENTS

| | | | | |
|---|---|---|---|---|
| 5,660,106 | A | 8/1997 | Pitz et al. | |
| 6,508,172 | B2 * | 1/2003 | Kusaka | B41F 33/0036 101/170 |
| 6,646,280 | B1 * | 11/2003 | Schaede | B65H 29/62 101/483 |
| 7,096,784 | B2 | 8/2006 | Giori et al. | |
| 7,216,583 | B2 | 5/2007 | Schaede | |
| 7,273,008 | B2 | 9/2007 | Giori et al. | |
| 8,328,194 | B2 | 12/2012 | Reinhard et al. | |
| 8,671,836 | B2 | 3/2014 | Würsch et al. | |
| 8,783,685 | B2 | 7/2014 | Reinhard et al. | |
| 2005/0223922 | A1 | 10/2005 | Giori et al. | |
| 2006/0162585 | A1 | 7/2006 | Schaede | |
| 2006/0208412 | A1 | 9/2006 | Reinhard et al. | |
| 2006/0213384 | A1 | 9/2006 | Reinhard et al. | |
| 2006/0249040 | A1 | 11/2006 | Giori et al. | |
| 2007/0175912 | A1 * | 8/2007 | Uehara | B65H 29/62 221/30 |
| 2009/0003656 | A1 | 1/2009 | Reinhard et al. | |
| 2009/0235832 | A1 * | 9/2009 | Wursch | B41F 13/0032 101/77 |
| 2011/0299722 | A1 * | 12/2011 | Schaede | B65H 35/02 382/100 |
| 2011/0315760 | A1 * | 12/2011 | Ito | G07D 11/0021 235/375 |
| 2013/0176356 | A1 | 7/2013 | Reinhard et al. | |
| 2014/0165862 | A1 | 6/2014 | Wursch et al. | |

FOREIGN PATENT DOCUMENTS

| | | |
|---|---|---|
| EP | 2 189 407 | 5/2010 |
| WO | WO 01/85457 | 11/2001 |
| WO | WO 2004/016433 | 2/2004 |
| WO | WO 2005/008605 | 1/2005 |
| WO | WO 2005/008606 | 1/2005 |
| WO | WO 2007/148288 | 12/2007 |

OTHER PUBLICATIONS

Written Opinion of the ISA for PCT/IB2014/059271, dated Jul. 7, 2014, 6 pages.

* cited by examiner

NUMBERING SCHEME N1

NUMBERING SCHEME N2

NUMBERING SCHEME N2'

NUMBERING SCHEME N*

SHEET NUMBERING PROCESS AND SHEET-PROCESSING MACHINE FOR CARRYING OUT THE SAME

This application is the U.S. national phase of International Application No. PCT/162014/059271 filed 26 Feb. 2014, which designated the U.S. and claims priority to EP Patent Application No. 13157342.0 filed 28 Feb. 2013, the entire contents of each of which are hereby incorporated by reference.

TECHNICAL FIELD

The present invention generally relates to a sheet numbering process and a sheet-processing machine for carrying out such sheet numbering process. The invention is in particular applicable to the production of banknotes and like securities.

BACKGROUND OF THE INVENTION

Banknotes and like securities are commonly produced in the form of individual sheets (or successive portions of a continuous web which are ultimately cut into sheets) each carrying a plurality of individual imprints arranged in a matrix of rows and columns, which sheets are subjected to various printing and processing steps before being cut into individual notes. Among the printing and processing steps typically carried out during the production of banknotes are offset printing, intaglio printing, silk-screen printing, foil application, letterpress printing and/or varnishing. Other processing steps might be carried out during the production such as window cutting, ink-jet marking, laser marking, micro-perforation, etc. Once fully printed, the sheets have to be subjected to a so-called finishing process wherein the sheets are processed, i.e. cut and assembled, to form note bundles and packs of note bundles.

Banknotes and like securities further have to typically meet strict quality requirements, especially concerning the printing quality thereof. Therefore, during the course of their production, banknotes or securities are typically inspected in order to detect, and advantageously mark, defective notes, i.e. notes exhibiting a low printing quality, printing errors, physical damages and the like, such that these defective notes can be sorted out. Inspection can be carried out at various stages of the production, manually, on-line on the printing or processing presses, and/or off-line on dedicated inspection machines. Final inspection of the banknotes is conveniently carried out prior to finishing as this will be explained hereinafter in reference to FIG. 1 which is illustrative of the prior art.

FIG. 1 summarizes a typical process of producing securities wherein a final inspection step is carried out prior to finishing. The production process illustrated in FIG. 1 is advantageous in that it enables maximisation of the production efficiency by reducing waste to a minimum and enables the production of note bundles and packs of note bundles with uninterrupted numbering sequence.

Step 501 in FIG. 1 denotes the various printing phases which are typically carried out during the production of securities. As mentioned, these various printing phases include in particular an offset printing phase whereby sheets of securities are printed on one or both sides with an offset background, an intaglio printing phase whereby the sheets are printed on one or both sides with intaglio features (i.e. embossed/relief features which are readily recognizable by touch), a silk-screen printing phase whereby the sheets are printed on one or both sides with silk-screen features, such as features made of optically variable ink (OVI), and/or a foil/patch application phase whereby foils or patches, in particular so-called optically variable devices (OVD), holograms, or similar optically diffractive structures, are applied onto one or both sides of the sheets, etc.

As a result of the various printing phases of step 501, successive sheets S are produced. While quality control checks are usually performed at various stages during the production of the securities, a final quality check is typically carried out on the full sheets S after these have been completely printed. This full-sheet quality inspection is schematised by step 502 in FIG. 1. Three categories of sheets in terms of quality requirements are generated as a result of this full-sheet quality inspection, namely (i) entirely good sheets $S^0$ (i.e. sheets carrying imprints which are all regarded to be satisfactory from the point of view of the quality requirements), (ii) partially defective sheets S' (i.e. sheets carrying a mixtures of imprints which are satisfactory from the point of view of the quality requirements and imprints which are unacceptable, which defective imprints are typically provided with a distinct cancellation mark), and (iii) entirely defective sheets $S^X$ carrying only defective imprints. From this point onward, the three categories of sheets follow distinct routes. More precisely, the entirely defective sheets $S^X$ are destroyed at step 510, while the entirely good sheets $S^0$ are processed at steps 503 to 505 and the partially defective sheets S' are processed at steps 520 to 523.

Referring to steps 503 to 505, the entirely good sheets $S^0$ are typically numbered at step 503, then optionally varnished at step 504, and finally cut and subjected to an ultimate finishing process at step 505, i.e. stacks of sheets S are cut into individual bundles of securities (such as banknote bundles) 200, which bundles 200 are typically banderoled (i.e. surrounded with a securing band) and then stacked to form packs of bundles 210. While the sheets S are processed in succession at steps 503 and 504, step 505 is usually carried out on stacks of hundred sheets each, thereby producing successive note bundles 200 of hundred securities each, which note bundles 200 are stacked to form e.g. packs 210 of ten note bundles each.

Referring to steps 520 to 523, the partially defective sheets S' are firstly cut into individual notes at step 520 and the resulting securities are then sorted out at step 521 (based on the presence or absence of the cancellation mark previously applied on the defective imprints at step 502), the defective notes being destroyed at step 510, while the good notes are further processed at steps 522 and 523. At step 522, the individual securities are numbered in succession and subsequently subjected to a finishing process at step 523 which is similar to that carried out at step 505, i.e. note bundles of securities 200 are formed, which note bundles 200 are banderoled and then stacked to form packs of note bundles 210.

As regards the varnishing operation, FIG. 1 shows that such varnishing is typically carried out on full sheets at step 504 after full-sheet numbering at step 503. While this varnishing step is preferred, it is not as such required. Varnishing may furthermore be carried out at a different stage of the production, for example before full-sheet inspection at step 502 or immediately after full-sheet inspection at step 502, on the entirely good sheets $S^0$ and partially defective sheets S' (which other solution would imply that numbering is carried out after varnishing).

In case keeping the numbering sequence throughout the notes of successive bundles 200 is not required, the partially defective sheets S' could follow a somewhat similar route as the entirely good sheets $S^0$, i.e. be subjected to a full-sheet numbering step (thereby numbering both the good and defective imprints), then to full-sheet varnishing, before being cut into individual securities, sorted out to extract and destroy the defective securities, and then subjected to an ultimate finishing process to form note bundles and packs of note bundles (in this case single-note numbering would not be required).

In all of the above instances, the entirely good sheets $S^0$ and the partially defective sheets S' follow distinct routes and are numbered in separate numbering processes. This may create logistical problems in that the entirely good sheets $S^0$ and the partially defective sheets S' have to be routed to different locations and handled differently and separately.

European Patent Publication EP 1 808 391 A1 discloses, with reference to FIGS. 7A-7E thereof, a sheet numbering process whereby sheets carrying a plurality of imprints that are arranged in a matrix of rows and columns are first inspected with a view to identify specific groups of partly defective sheets where defects are concentrating within single columns of imprints and sorting these sheets in dependence of the relevant column where the defects are located Once sorted, the relevant sheets are numbered by causing the relevant numbering and imprinting machine to omit numbering in the individual columns where one or more defects have been identified or by removing the corresponding numbering devices from the numbering and imprinting machine.

A considerable disadvantage of this known process resides in the fact that it requires a complex sorting operation prior to the numbering operation. A further disadvantage of this known process resides in the fact that imprints that are not considered to be defective but that happen to be located within the same column where a defect is detected are not at all numbered, thus generating unnecessary waste. Furthermore, the process of EP 1 808 391 A1 requires individual and separate numbering of each specific group of partly defective sheets in dependence of the sorting of the sheets. This numbering is carried out on a separate numbering and imprinting machine which is pre-set in dependence of the relevant group of partly defective sheets to be numbered (namely by turning off or removing the relevant numbering devices) prior to undertaking the numbering operation.

There is therefore a need for an improved process of numbering sheets, and a sheet-processing machine enabling the same, which simplifies logistics as far as numbering of the sheets is concerned. There is furthermore a need for such an improved process of numbering sheets (and related sheet-processing machine) that is more flexible than the known solutions.

SUMMARY OF THE INVENTION

A general aim of the invention is therefore to provide an improved process of numbering sheets, and a sheet-processing machine enabling the same.

A further aim of the invention is to provide such a process of numbering sheets and related sheet-processing machine that allow a more efficient and centralized handling of the numbering of the sheets, especially of entirely good sheets as well as of partially defective sheets.

Another aim of the invention is to provide such a solution that allows more flexibility in the numbering schemes that are to be carried out on the sheets.

These aims are achieved thanks to the sheet numbering process and sheet-processing machine as defined in the claims.

Further advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Figure 2:
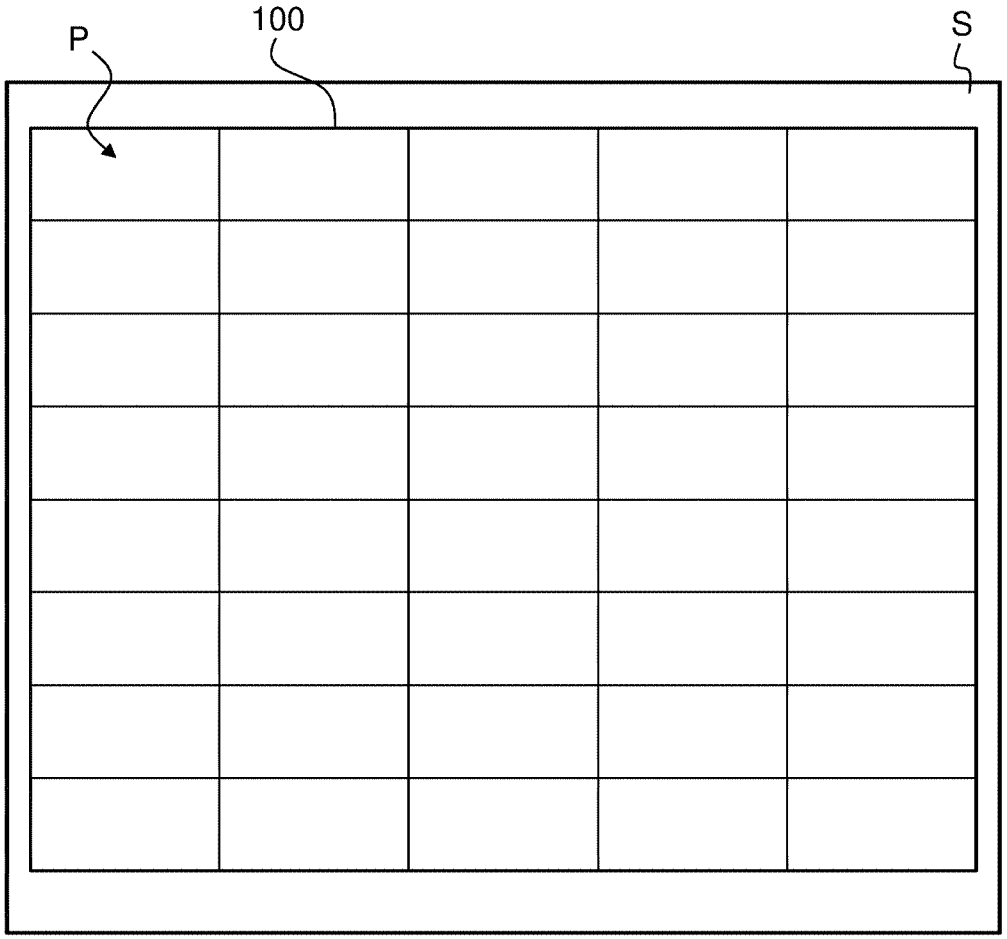
FIG. 2 is a schematic illustration of a (yet unnumbered) sheet as used for the production of securities (such as banknotes), which sheet carries a plurality of imprints that are arranged in a matrix of (e.g. eight) rows and (e.g. five) columns.

The present invention will be described in the particular context of the production of banknotes. As already mentioned, banknotes are typically produced in the form of sheets each carrying a plurality of imprints which are arranged in a matrix of rows and columns. FIG. 2 schematically illustrates a sheet S as used for the production of banknotes, which sheet S bears an effective printed area 100 consisting of multiple (banknote) imprints P which are arranged in a regular pattern of rows and columns. The sheet S exhibits margin portions next to the effective printed area 100, which margin portions are typically exploited for the purpose of printing control patterns or the like.

Figure 3:
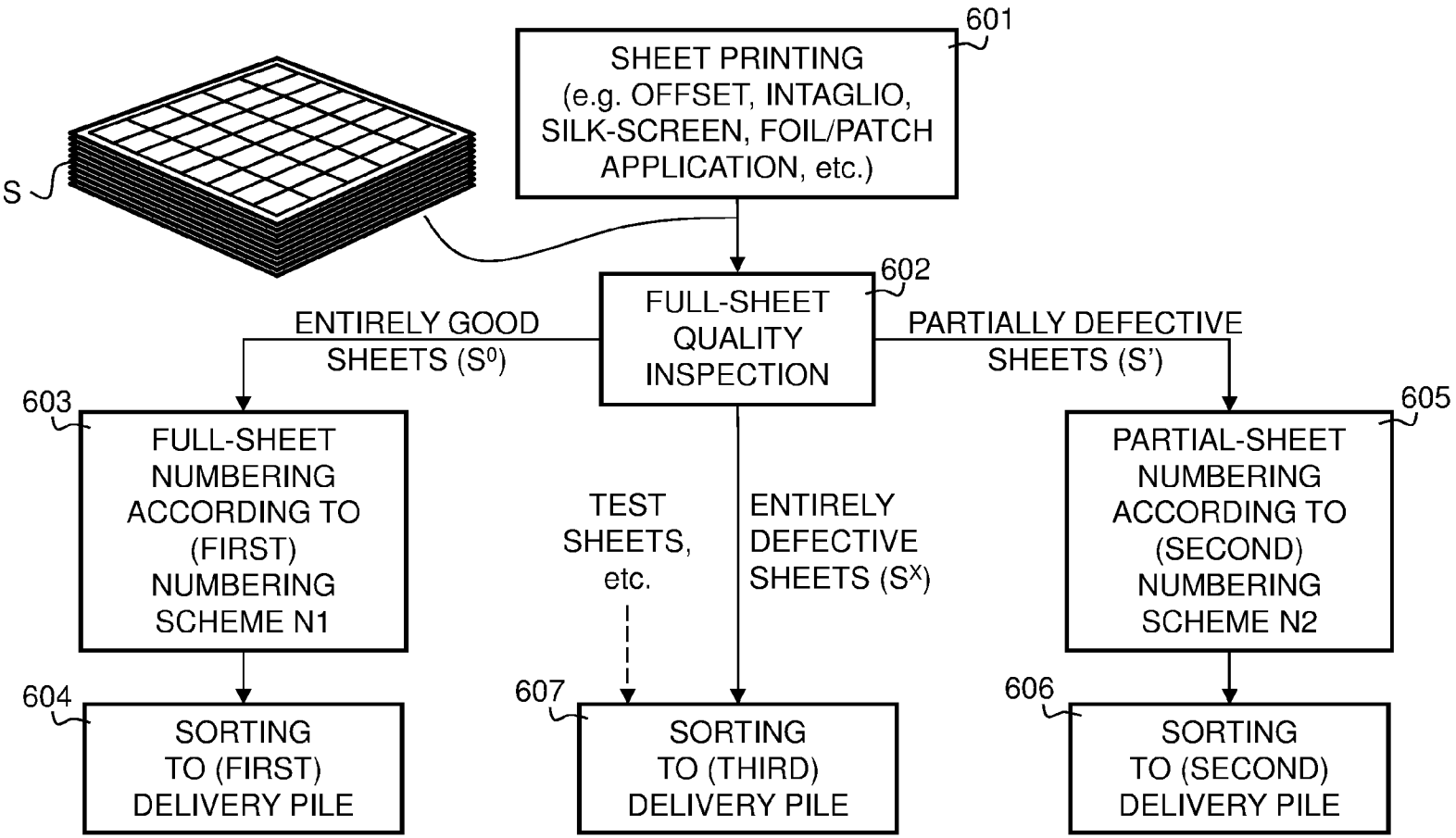
FIG. 3 is a flow chart illustrating an embodiment of the invention as applied in the context of the numbering of sheets which are subjected to full-sheet inspection prior to numbering of the sheets.

FIG. 3 is a flow chart illustrating an embodiment of the invention as applied in the context of the numbering of the sheets S, which sheets are subjected to full-sheet inspection prior to numbering of the sheets.

Figure 1:
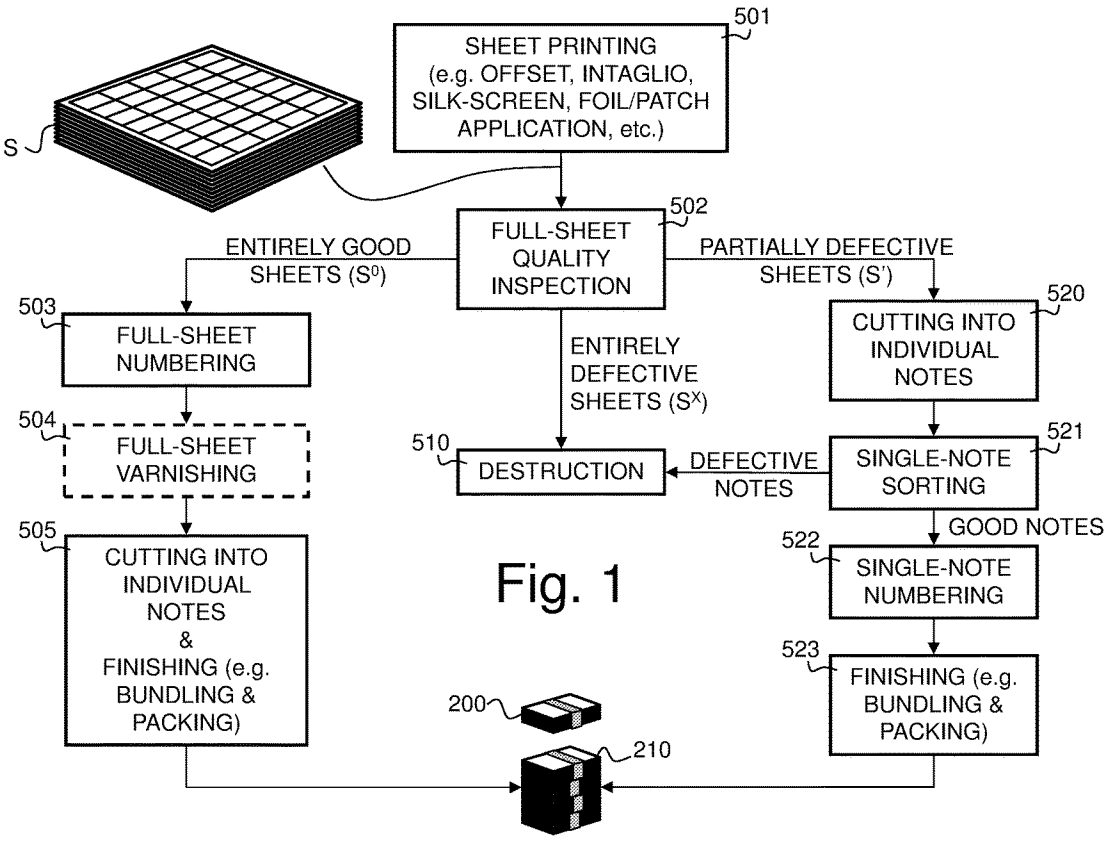
FIG. 1 is a flow chart illustrating a known process for producing notes of securities (such as banknotes) wherein a small part of the production is subjected to single-note processing.

Step 601 in FIG. 3 denotes the various printing phases which are typically carried out during the production of securities (like step 501 of FIG. 1). As a result of the various printing phases of step 601, successive sheets S are produced, which sheets are subjected to a final quality check as schematised by step 602 in FIG. 3. Once again, three categories of sheets in terms of quality requirements are generated as a result of this full-sheet quality inspection, namely (i) entirely good sheets $S^0$ (i.e. sheets carrying exclusive good imprints), (ii) partially defective sheets S' (i.e. sheets carrying a mixture of good and defective imprints), and (iii) entirely defective sheets $S^X$ carrying only defective imprints. From this point onward, the three categories of sheets follow distinct routes.

More precisely, the entirely good sheets $S^0$ are subjected at step 603 to a full-sheet numbering process according to a first numbering scheme, designated by reference N1, and then sorted to a (first) sheet delivery pile unit at step 604. The partially defective sheets S', on the other hand, are subjected at step 605 to a partial-sheet numbering process according to a second numbering scheme, designated by reference N2, which is different from the first numbering scheme N1, and then sorted to a (second) sheet delivery pile unit at step 606. The entirely defective sheets $S^X$, which exclusively carry defective imprints, are not numbered and sorted to a (third) sheet delivery pile unit at step 607.

It is to be appreciated that full-sheet numbering at step 603 and partial-sheet numbering at step 605 are performed, according to the invention, at the same numbering location (i.e. on the same sheet-processing machine) without interruption of the numbering process. That is, numbering of the individual sheets S is selectively commutable between a first numbering scheme and at least a second numbering scheme, different from the first numbering scheme, without interruption of the numbering process. This will now be explained in greater detail with reference to FIGS. 4 to 6 hereof.

Figure 4:
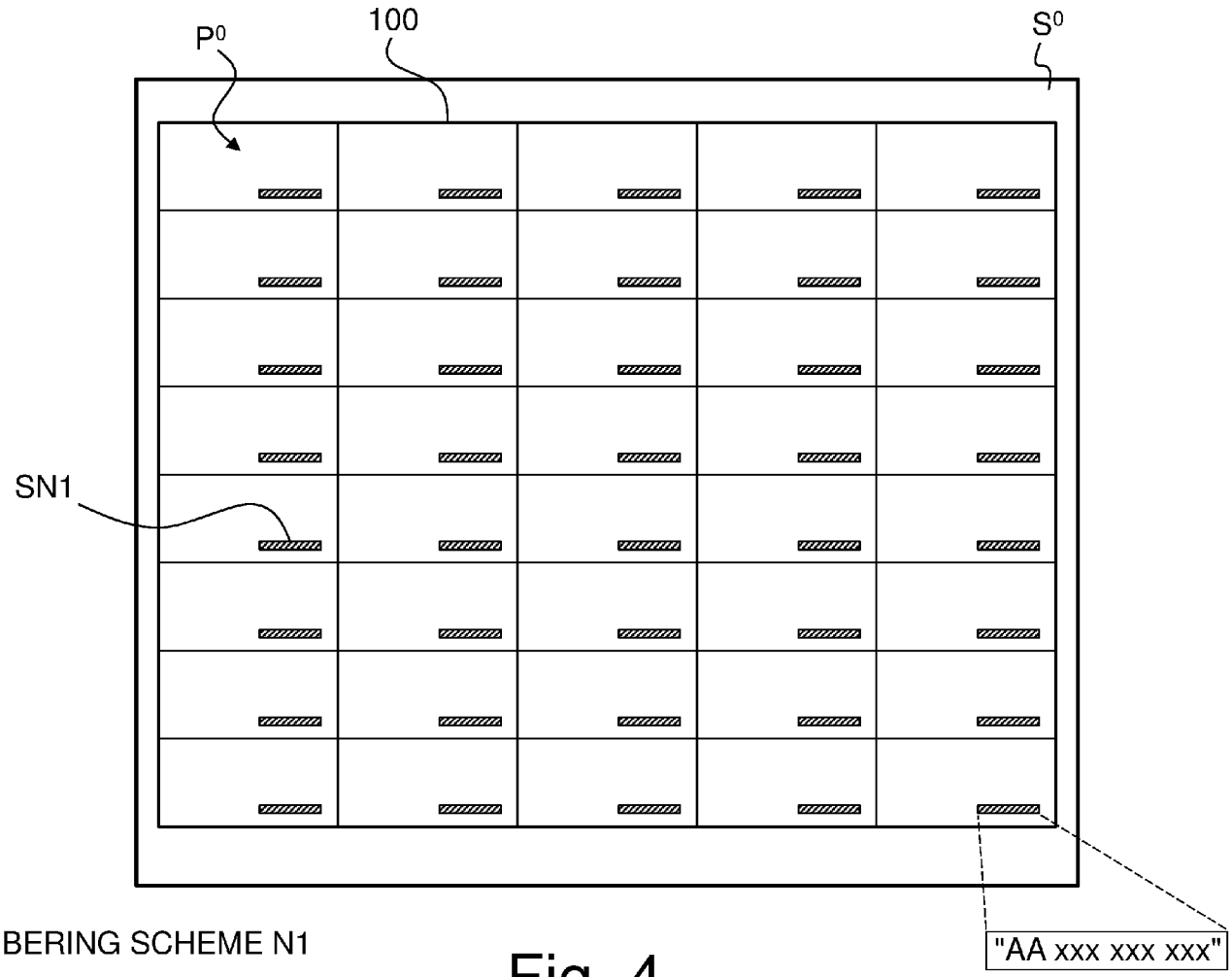
FIG. 4 is a schematic illustration of an entirely good sheet (i.e. a sheet whose imprints meet quality requirements) which is numbered according to a first numbering scheme.

FIG. 4 schematically illustrates an entirely good sheet $S^0$, i.e. an inspected sheet which has been classified, as a result of the full-sheet inspection, as carrying only good imprints, which are designated by reference $P^0$ in FIG. 4 for the sake of distinction. As a result of the full-sheet numbering step 603 of FIG. 3, each imprint $P^0$ has been provided with a unique serial number, which is generically identified by reference SN1, which unique serial number SN1 is provided in dependence of the selected first numbering scheme N1.

This first numbering scheme N1 can basically be any suitable numbering scheme. The first numbering scheme N1 is however preferably a so-called non-collating numbering scheme, i.e. a particular numbering scheme that allows continued and uninterrupted finishing of consecutively-numbered documents. Such a non-collating numbering scheme is disclosed in International Patent Publication No. WO 2004/016433 A1, which is incorporated herein by reference in its entirety, and will not be described in great detail here. It suffices to understand that the sheets are numbered in successive runs of e.g. hundred sheets each and in such a way that each run of hundred sheets yields a corresponding number of consecutively-numbered documents.

Let us assume for the sake of illustration that one wishes to produce one million numbered notes with serial numbers ranging from "AA 000 000 000" to "AA 000 999 999". As disclosed in International Patent Publication No. WO 2004/016433 A1, numbering can conveniently be carried out downwards from e.g. the starting number "AA 000 999 999" and by appropriately numbering the sheets as follows. One will assume that each sheet carries forty imprints that are arranged in a matrix of eight rows and five columns as for instance illustrated in FIG. 4. The first sheet to be numbered (i.e. the first sheet of the first run of hundred sheets) would be numbered in accordance with the following table (1) where each position in the table corresponds to the relevant imprint position on the sheet:

TABLE (1)

(serial numbers SN1 of first sheet of first run of hundred sheets)

| | | | | |
|---|---|---|---|---|
| AA 000 999 999 | AA 000 999 199 | AA 000 998 399 | AA 000 997 599 | AA 000 996 799 |
| AA 000 999 899 | AA 000 999 099 | AA 000 998 299 | AA 000 997 499 | AA 000 996 699 |
| AA 000 999 799 | AA 000 998 999 | AA 000 998 199 | AA 000 997 399 | AA 000 996 599 |
| AA 000 999 699 | AA 000 998 899 | AA 000 998 099 | AA 000 997 299 | AA 000 996 499 |
| AA 000 999 599 | AA 000 998 799 | AA 000 997 999 | AA 000 997 199 | AA 000 996 399 |
| AA 000 999 499 | AA 000 998 699 | AA 000 997 899 | AA 000 997 099 | AA 000 996 299 |
| AA 000 999 399 | AA 000 998 599 | AA 000 997 799 | AA 000 996 999 | AA 000 996 199 |
| AA 000 999 299 | AA 000 998 499 | AA 000 997 699 | AA 000 996 899 | AA 000 996 099 |

In accordance with International Patent Publication No. WO 2004/016433 A1 the subsequent ninety-nine sheets of the same run of hundred sheets are numbered in decreasing sequence, thereby leading to the last sheet of the first run (i.e. the hundredth sheet) being numbered in accordance with table (2) hereafter:

TABLE (2)

(serial numbers SN1 of last sheet of first run of hundred sheets)

| | | | | |
|---|---|---|---|---|
| AA 000 999 900 | AA 000 999 100 | AA 000 998 300 | AA 000 997 500 | AA 000 996 700 |
| AA 000 999 800 | AA 000 999 000 | AA 000 998 200 | AA 000 997 400 | AA 000 996 600 |
| AA 000 999 700 | AA 000 998 900 | AA 000 998 100 | AA 000 997 300 | AA 000 996 500 |
| AA 000 999 600 | AA 000 998 800 | AA 000 998 000 | AA 000 997 200 | AA 000 996 400 |

TABLE (2)-continued

| (serial numbers SN1 of last sheet of first run of hundred sheets) | | | | |
|---|---|---|---|---|
| AA 000 999 500 | AA 000 998 700 | AA 000 997 900 | AA 000 997 100 | AA 000 996 300 |
| AA 000 999 400 | AA 000 998 600 | AA 000 997 800 | AA 000 997 000 | AA 000 996 200 |
| AA 000 999 300 | AA 000 998 500 | AA 000 997 700 | AA 000 996 900 | AA 000 996 100 |
| AA 000 999 200 | AA 000 998 400 | AA 000 997 600 | AA 000 996 800 | AA 000 996 000 |

Stacking of the thus-numbered hundred sheets of the first run and row-wise and column-wise cutting of the stack thereby allows to produce an uninterrupted sequence of four thousand (forty times hundred) individual notes whose serial numbers form a consecutive sequence of serial numbers ranging from "AA 000 999 999" to "AA 000 996 000".

In accordance with the teaching of International Patent Publication No. WO 2004/016433 A1 the first sheet of the next (i.e. second) run of hundred sheets is numbered with new serial numbers as starting numbers, namely in accordance with table (3) hereafter:

TABLE (3)

| (serial numbers SN1 of first sheet of second run of hundred sheets) | | | | |
|---|---|---|---|---|
| AA 000 995 999 | AA 000 995 199 | AA 000 994 399 | AA 000 993 599 | AA 000 992 799 |
| AA 000 995 899 | AA 000 995 099 | AA 000 994 299 | AA 000 993 499 | AA 000 992 699 |
| AA 000 995 799 | AA 000 994 999 | AA 000 994 199 | AA 000 993 399 | AA 000 992 599 |
| AA 000 995 699 | AA 000 994 899 | AA 000 994 099 | AA 000 993 299 | AA 000 992 499 |
| AA 000 995 599 | AA 000 994 799 | AA 000 993 999 | AA 000 993 199 | AA 000 992 399 |
| AA 000 995 499 | AA 000 994 699 | AA 000 993 899 | AA 000 993 099 | AA 000 992 299 |
| AA 000 995 399 | AA 000 994 599 | AA 000 993 799 | AA 000 992 999 | AA 000 992 199 |
| AA 000 995 299 | AA 000 994 499 | AA 000 993 699 | AA 000 992 899 | AA 000 992 099 |

The subsequent ninety-nine sheets of the second run of hundred sheets are then likewise numbered in decreasing sequence, thereby leading to the production of another set of four thousand individual notes whose serial numbers form a consecutive sequence of serial numbers ranging this time from "AA 000 995 999" to "AA 000 992 000", i.e. a set of notes directly following the numerical sequence of the previous set of four thousand notes mentioned above.

Production of one million notes according to the above-mentioned numbering scheme therefore requires two-hundred and fifty runs of hundred sheets, with the last sheet of the $250^{th}$ run bearing the last series of serial numbers in accordance with table (4) hereafter:

TABLE (4)

| (serial numbers SN1 of last sheet of $250^{th}$ run of hundred sheets) | | | | |
|---|---|---|---|---|
| AA 000 003 900 | AA 000 003 100 | AA 000 002 300 | AA 000 001 500 | AA 000 000 700 |
| AA 000 003 800 | AA 000 003 000 | AA 000 002 200 | AA 000 001 400 | AA 000 000 600 |
| AA 000 003 700 | AA 000 002 900 | AA 000 002 100 | AA 000 001 300 | AA 000 000 500 |
| AA 000 003 600 | AA 000 002 800 | AA 000 002 000 | AA 000 001 200 | AA 000 000 400 |
| AA 000 003 500 | AA 000 002 700 | AA 000 001 900 | AA 000 001 100 | AA 000 000 300 |
| AA 000 003 400 | AA 000 002 600 | AA 000 001 800 | AA 000 001 000 | AA 000 000 200 |
| AA 000 003 300 | AA 000 002 500 | AA 000 001 700 | AA 000 000 900 | AA 000 000 100 |
| AA 000 003 200 | AA 000 002 400 | AA 000 001 600 | AA 000 000 800 | AA 000 000 000 |

In contrast to the entirely good sheets $S^0$ which can conveniently be numbered according to the above non-collating numbering scheme, the partially defective sheets S' cannot be numbered in the same way due to the presence of defective prints which would break the numbering sequence. One solution is therefore to number the partially defective sheets S' by skipping the defective imprint(s) and adjusting the numbering sequence accordingly.

Figure 5:
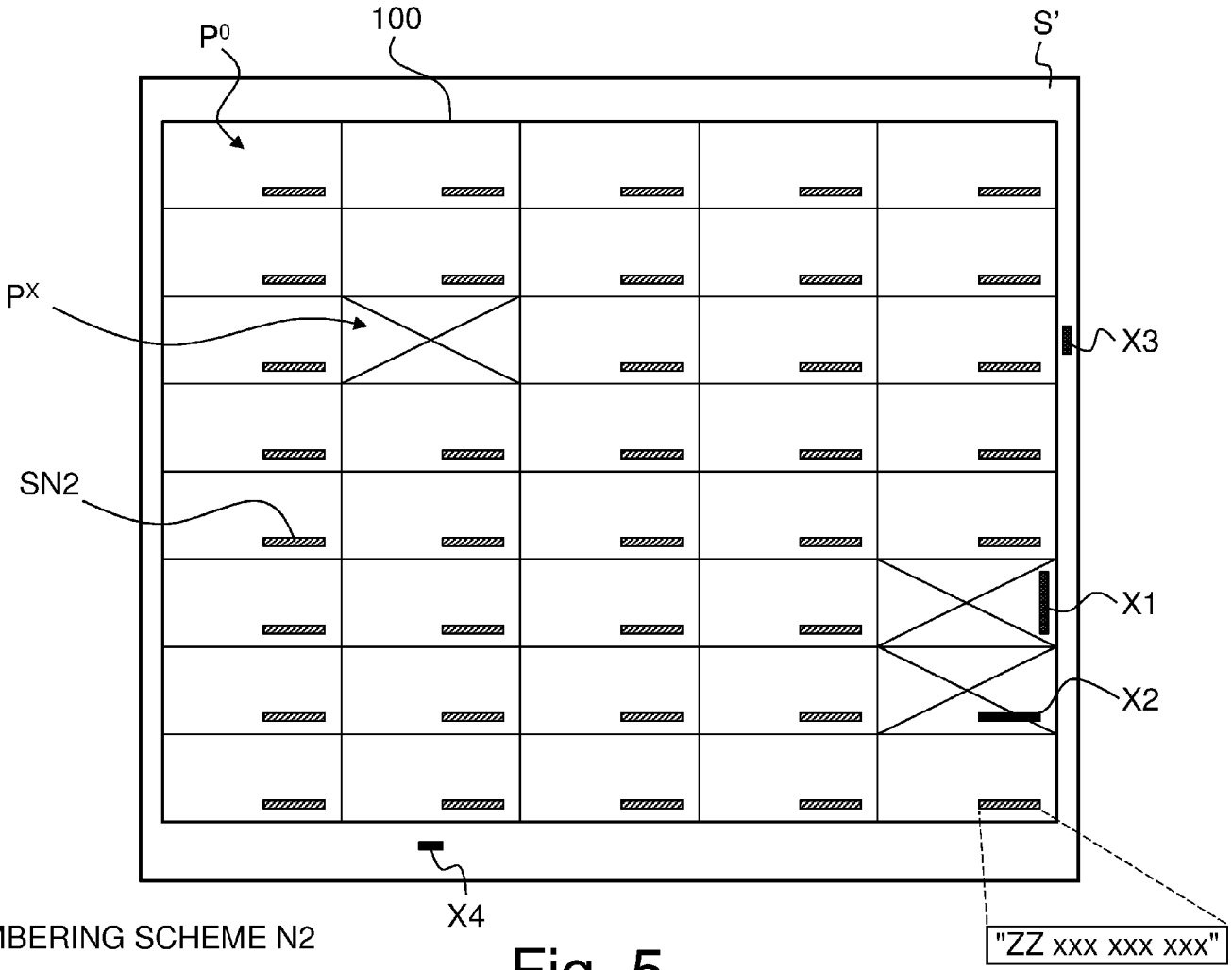
FIG. 5 is a schematic illustration of a partially defective sheet (i.e. a sheet carrying a mixture of good imprints and defective imprints) which is numbered according to first and second variants of a second numbering scheme, different from the first numbering scheme.

Let us look at FIG. 5 which is a schematic illustration of a partially defective sheet S' which carries defective prints, designated by reference $P^X$ for the sake of distinction, at three different locations, namely on the third row of the second column and the sixth and seventh rows of the fifth column (as schematically illustrated by a corresponding cross in FIG. 5). In this example, all other imprints, which are considered to be good imprints $P^0$, are each provided with a unique serial number, which is generically identified by reference SN2 in this other example.

The location of the defective imprints $P^X$ can be indicated by a corresponding cancellation mark provided directly on the relevant defective imprint(s) $P^X$ or appropriately identifying the location(s) of the relevant defective imprint(s) $P^X$. Various solutions are possible, including a specific cancellation mark X1 provided on the relevant defective imprint (for instance by means of a dedicated marking system) or, more advantageously, a cancellation mark X2 provided by means of the relevant numbering box (in which case the cancellation mark is located at the same location as the serial numbers SN2). Other solutions are possible, such as cancellation marks X3, X4 which are provided outside of the effective printed area 100 of the sheet S'.

Numbering of the partially defective sheet S' of FIG. 5 can for instance be carried out as indicated by the following table (5), it being assumed that we are looking at the first sheet of a series of partially defective sheets S':

TABLE (5)

| (serial numbers SN2 of first partially defective sheet - first variant) | | | | |
|---|---|---|---|---|
| ZZ 000 999 999 | ZZ 000 999 199 | ZZ 000 998 399 | ZZ 000 997 599 | ZZ 000 996 799 |
| ZZ 000 999 899 | ZZ 000 999 099 | ZZ 000 998 299 | ZZ 000 997 499 | ZZ 000 996 699 |
| ZZ 000 999 799 | DEFECT | ZZ 000 998 199 | ZZ 000 997 399 | ZZ 000 996 599 |
| ZZ 000 999 699 | ZZ 000 998 899 | ZZ 000 998 099 | ZZ 000 997 299 | ZZ 000 996 499 |
| ZZ 000 999 599 | ZZ 000 998 799 | ZZ 000 997 999 | ZZ 000 997 199 | ZZ 000 996 399 |
| ZZ 000 999 499 | ZZ 000 998 699 | ZZ 000 997 899 | ZZ 000 997 099 | DEFECT |
| ZZ 000 999 399 | ZZ 000 998 599 | ZZ 000 997 799 | ZZ 000 996 999 | DEFECT |
| ZZ 000 999 299 | ZZ 000 998 499 | ZZ 000 997 699 | ZZ 000 996 899 | ZZ 000 996 099 |

Let us assume that the next partially defective sheet S' to be detected as a result of the full-sheet inspection includes a single defective imprint $P^X$ located on the fifth row of the third column of the sheet, one could contemplate to number this second partially defective sheet S' in accordance with table (6) hereafter:

TABLE (6)

| (serial numbers SN2 of second partially defective sheet - first variant) | | | | |
|---|---|---|---|---|
| ZZ 000 999 998 | ZZ 000 999 198 | ZZ 000 998 398 | ZZ 000 997 598 | ZZ 000 996 798 |
| ZZ 000 999 898 | ZZ 000 999 098 | ZZ 000 998 298 | ZZ 000 997 498 | ZZ 000 996 698 |
| ZZ 000 999 798 | ZZ 000 998 999 | ZZ 000 998 198 | ZZ 000 997 398 | ZZ 000 996 598 |
| ZZ 000 999 698 | ZZ 000 998 898 | ZZ 000 998 098 | ZZ 000 997 298 | ZZ 000 996 498 |
| ZZ 000 999 598 | ZZ 000 998 798 | DEFECT | ZZ 000 997 198 | ZZ 000 996 398 |
| ZZ 000 999 498 | ZZ 000 998 698 | ZZ 000 997 898 | ZZ 000 997 098 | ZZ 000 996 299 |
| ZZ 000 999 398 | ZZ 000 998 598 | ZZ 000 997 798 | ZZ 000 996 998 | ZZ 000 996 199 |
| ZZ 000 999 298 | ZZ 000 998 498 | ZZ 000 997 698 | ZZ 000 996 898 | ZZ 000 996 098 |

According to this first variant of the second numbering scheme, one shall therefore understand that consecutive numbering sequences are formed in each imprint location, the defective imprints $P^X$ being skipped on a sheet by sheet basis.

According to another variant, the second numbering scheme may provide for the skipping of the defective imprints $P^X$ within each sheet as indicated by the following table (7)

TABLE (7)

| (serial numbers SN2 of first partially defective sheet - second variant) | | | | |
|---|---|---|---|---|
| ZZ 000 999 999 | ZZ 000 999 991 | ZZ 000 999 984 | ZZ 000 999 976 | ZZ 000 999 968 |
| ZZ 000 999 998 | ZZ 000 999 990 | ZZ 000 999 983 | ZZ 000 999 975 | ZZ 000 999 967 |
| ZZ 000 999 997 | DEFECT | ZZ 000 999 982 | ZZ 000 999 974 | ZZ 000 999 966 |
| ZZ 000 999 996 | ZZ 000 999 989 | ZZ 000 999 981 | ZZ 000 999 973 | ZZ 000 999 965 |
| ZZ 000 999 995 | ZZ 000 999 988 | ZZ 000 999 980 | ZZ 000 999 972 | ZZ 000 999 964 |
| ZZ 000 999 994 | ZZ 000 999 987 | ZZ 000 999 979 | ZZ 000 999 971 | DEFECT |
| ZZ 000 999 993 | ZZ 000 999 986 | ZZ 000 999 978 | ZZ 000 999 970 | DEFECT |
| ZZ 000 999 992 | ZZ 000 999 985 | ZZ 000 999 977 | ZZ 000 999 969 | ZZ 000 999 963 |

Assuming once again, for the sake of illustration that the next partially defective sheet S' to be detected as a result of the full-sheet inspection includes a single defective imprint $P^X$ located on the fifth row of the third column of the sheet, one could contemplate to number this second partially defective sheet S' in accordance with table (8) hereafter:

TABLE (8)

| (serial numbers SN2 of second partially defective sheet - first variant) | | | | |
|---|---|---|---|---|
| ZZ 000 999 962 | ZZ 000 999 954 | ZZ 000 999 946 | ZZ 000 999 939 | ZZ 000 999 931 |
| ZZ 000 999 961 | ZZ 000 999 953 | ZZ 000 999 945 | ZZ 000 999 938 | ZZ 000 999 930 |
| ZZ 000 999 960 | ZZ 000 999 952 | ZZ 000 999 944 | ZZ 000 999 937 | ZZ 000 999 929 |
| ZZ 000 999 959 | ZZ 000 999 951 | ZZ 000 999 943 | ZZ 000 999 936 | ZZ 000 999 928 |
| ZZ 000 999 958 | ZZ 000 999 950 | DEFECT | ZZ 000 999 935 | ZZ 000 999 927 |
| ZZ 000 999 957 | ZZ 000 999 949 | ZZ 000 999 942 | ZZ 000 999 934 | ZZ 000 999 926 |

TABLE (8)-continued

| (serial numbers SN2 of second partially defective sheet - first variant) | | | | |
|---|---|---|---|---|
| ZZ 000 999 956 | ZZ 000 999 948 | ZZ 000 999 941 | ZZ 000 999 933 | ZZ 000 999 925 |
| ZZ 000 999 955 | ZZ 000 999 947 | ZZ 000 999 940 | ZZ 000 999 932 | ZZ 000 999 924 |

Figure 6:
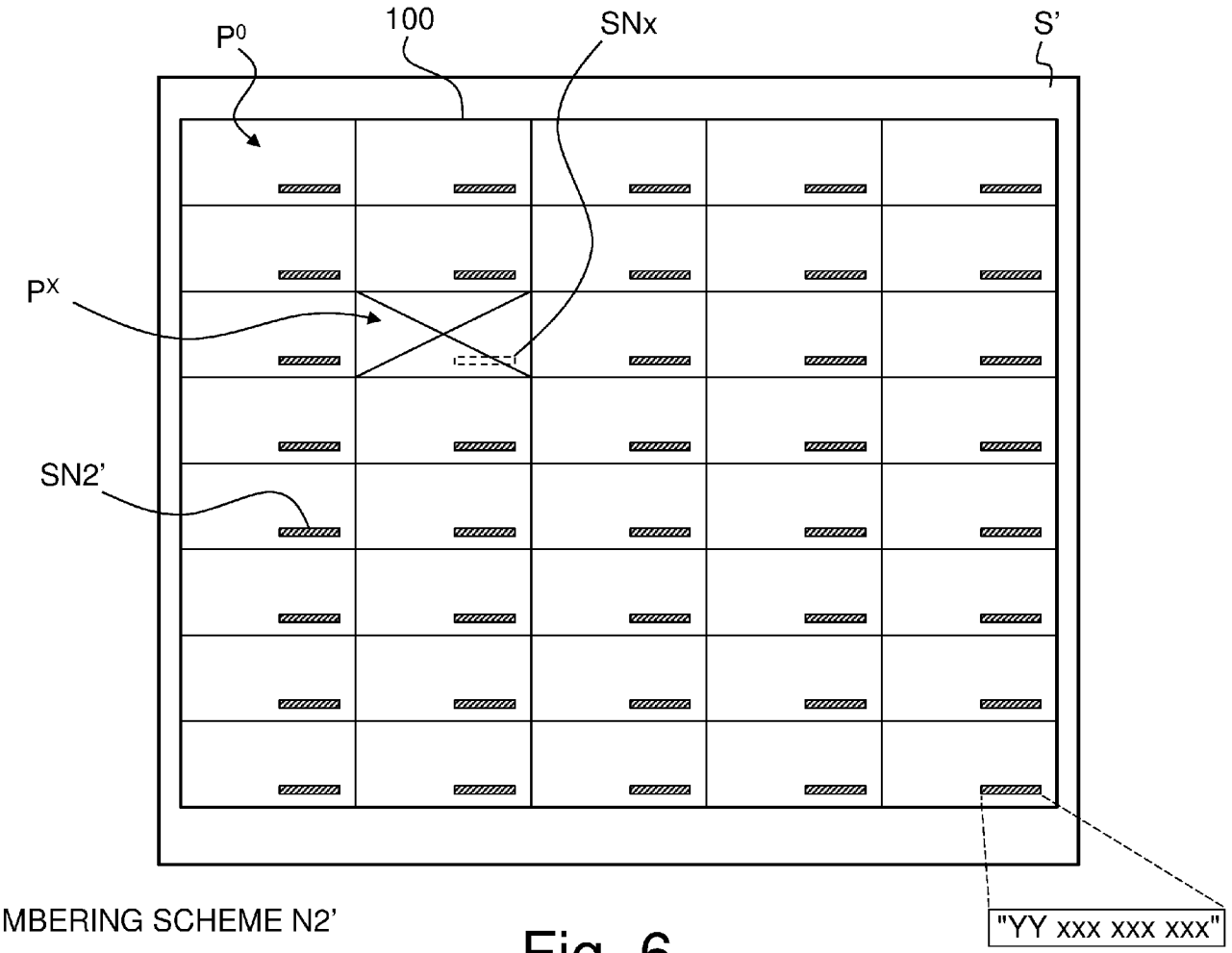
FIG. 6 is a schematic illustration of a partially defective sheet (i.e. a sheet carrying a mixture of good imprints and defective imprints) which is numbered according to another variant of a second numbering scheme, different from the first numbering scheme.

Yet another possibility is to skip the serial number(s) of the defective imprint(s) $P^X$ altogether as schematically illustrated by FIG. 6. This means that rather than adjusting the numbering sequence in dependence of the presence of defective imprints $P^X$, the corresponding serial numbers, which are generically identified by reference SNx, are simply discarded, while the good imprints are provided with a corresponding serial number, which is generically identified by reference SN2' in FIG. 6. The serial numbers may accordingly be provided in accordance with the following table (9):

TABLE (9)

| (serial numbers SN2' of first partially defective sheet) | | | | |
|---|---|---|---|---|
| YY 000 999 999 | YY 000 999 199 | YY 000 998 399 | YY 000 997 599 | YY 000 996 799 |
| YY 000 999 899 | YY 000 999 099 | YY 000 998 299 | YY 000 997 499 | YY 000 996 699 |
| YY 000 999 799 | DEFECT | YY 000 998 199 | YY 000 997 399 | YY 000 996 599 |
| YY 000 999 699 | YY 000 998 899 | YY 000 998 099 | YY 000 997 299 | YY 000 996 499 |
| YY 000 999 599 | YY 000 998 799 | YY 000 997 999 | YY 000 997 199 | YY 000 996 399 |
| YY 000 999 499 | YY 000 998 699 | YY 000 997 899 | YY 000 997 099 | DEFECT |
| YY 000 999 399 | YY 000 998 599 | YY 000 997 799 | YY 000 996 999 | DEFECT |
| YY 000 999 299 | YY 000 998 499 | YY 000 997 699 | YY 000 996 899 | YY 000 996 099 |

In the above example, one should therefore understand that serial numbers "YY 000 998 999", "YY 000 996 299" and "YY 000 996 199" corresponding to the defective imprints $P^X$ are discarded serial numbers (SNx).

Assuming once again, for the sake of illustration that the next partially defective sheet S' to be detected as a result of the full-sheet inspection includes a single defective imprint $P^X$ located on the fifth row of the third column of the sheet, one could contemplate to number this second partially defective sheet S' in accordance with table (10) hereafter:

TABLE (10)

| (serial numbers SN2 of second partially defective sheet - first variant) | | | | |
|---|---|---|---|---|
| YY 000 999 998 | YY 000 999 198 | YY 000 998 398 | YY 000 997 598 | YY 000 996 798 |
| YY 000 999 898 | YY 000 999 098 | YY 000 998 298 | YY 000 997 498 | YY 000 996 698 |
| YY 000 999 798 | YY 000 998 998 | YY 000 998 198 | YY 000 997 398 | YY 000 996 598 |
| YY 000 999 698 | YY 000 998 898 | YY 000 998 098 | YY 000 997 298 | YY 000 996 498 |
| YY 000 999 598 | YY 000 998 798 | DEFECT | YY 000 997 198 | YY 000 996 398 |
| YY 000 999 498 | YY 000 998 698 | YY 000 997 898 | YY 000 997 098 | YY 000 996 298 |
| YY 000 999 398 | YY 000 998 598 | YY 000 997 798 | YY 000 996 998 | YY 000 996 198 |
| YY 000 999 298 | YY 000 998 498 | YY 000 997 698 | YY 000 996 898 | YY 000 996 098 |

In this case, serial number "YY 000 997 998" corresponding to the defective imprint $P^X$ would likewise be a discarded serial number (SNx).

Figure 7:
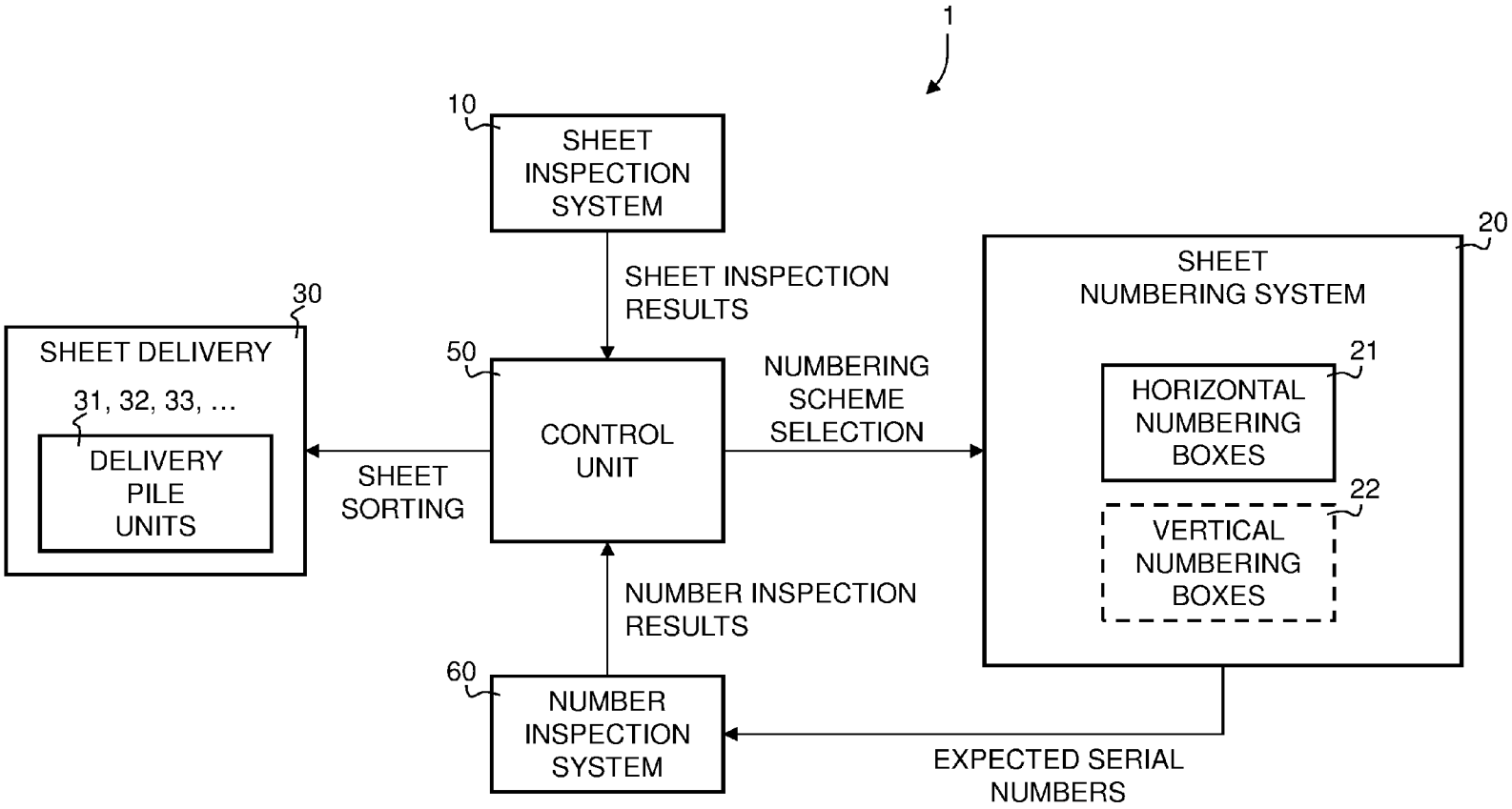
FIG. 7 is a schematic block diagram illustrating the functional components of a sheet-processing machine according to a preferred embodiment of the invention.
Figure 10:
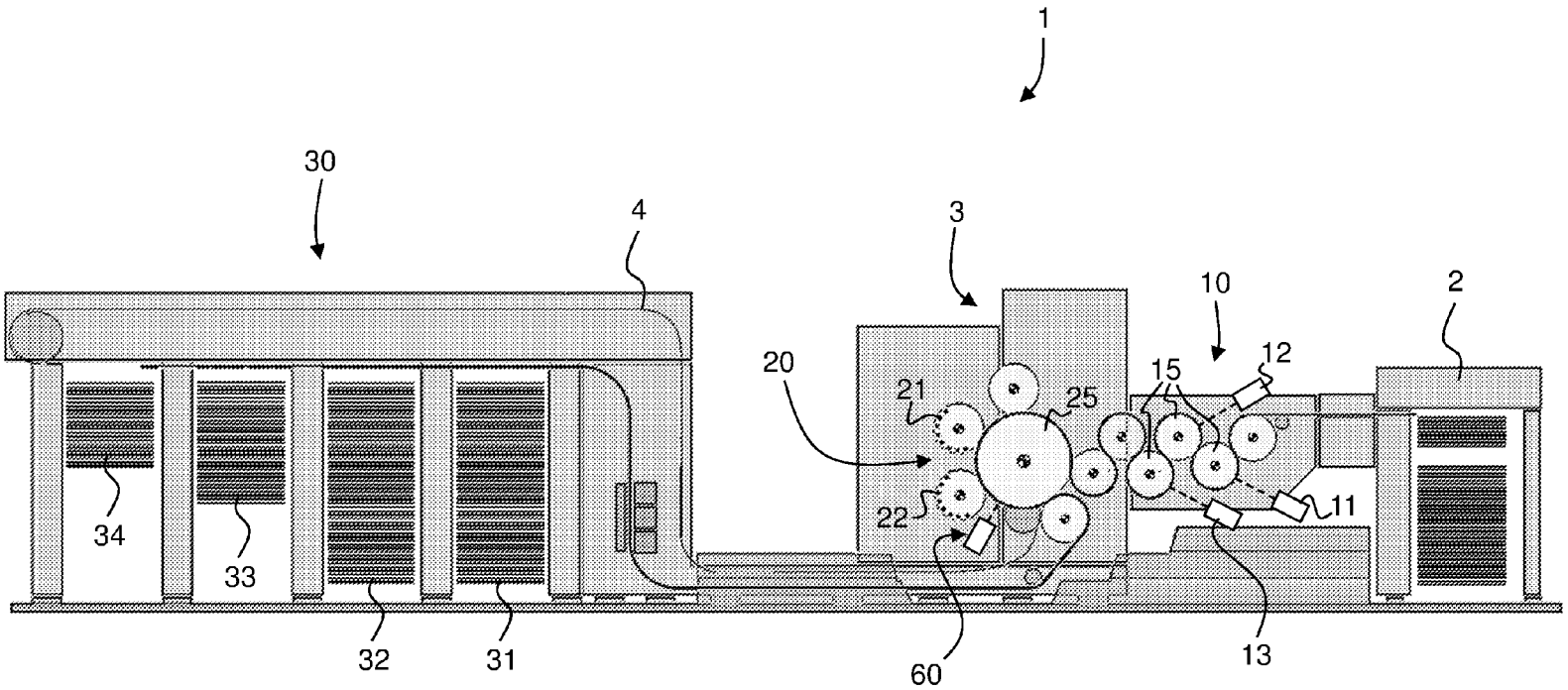
FIG. 10 is an illustrative example of a sheet-processing machine combining the functionalities of final inspection and sheet numbering.

FIG. 7 is a schematic block diagram illustrating the functional components of a sheet-processing machine, generally designated by reference numeral 1, according to a preferred embodiment of the invention, by means of which the above embodiments of the numbering process can be carried out. A concrete example of a suitable sheet-processing machine is shown in FIG. 10.

As illustrated in FIG. 7, inspection of the individual sheets S requires a suitable sheet inspection system which is schematically identified by the functional block designated by reference numeral 10. This sheet inspection system 10 provides feedback as regards the relevant sheet inspection results to a control unit 50, which control unit 50 in turns controls operation of a suitable sheet numbering system 20. As is typical in the art, the sheet numbering system 20 includes at least one set (typically two sets) of numbering boxes in a number corresponding to the number of imprints to be numbered (i.e. forty numbering boxes per set). Banknotes are typically provided with two identical serial numbers provided at different locations of the banknote surface, which requires two sets of numbering boxes. In some cases, one of the serial numbers is oriented horizontally, while the other serial number is oriented vertically, which requires one set of so-called horizontal numbering boxes (as identified by reference numeral 21 in FIG. 7) and one set of so-called vertical numbering boxes (as identified by reference numeral 22 in FIG. 7). Two sets of horizontal or, as the case may be, vertical numbering boxes are also possible.

In the context of the present invention, the control unit 50 is designed to selectively commute operation of the numbering system 20 between a first numbering scheme (such as the numbering scheme N1 discussed with reference to tables (1) to (4) and FIG. 4 hereof) and at least a second numbering scheme (such as the numbering scheme N2 or N2' discussed with reference to tables (5) to (10) and FIGS. 5, 6 hereof). This commutation is performed dynamically, without interruption of the numbering process, in dependence of the sheet inspection results provided by the sheet inspection system 10. In other words, in this particular example, the control unit 50 performs selection of the appropriate numbering scheme depending on whether the inspected sheet is an entirely good sheet or a partially defective sheet.

Advantageously, the control unit 50 further controls a sheet delivery 30 of the sheet-processing machine 1 so as to suitably sort the sheets in corresponding sheet delivery pile units (31, 32, 33, . . . ) as generally illustrated in the flow chart of FIG. 3.

As a further refinement, the sheet-processing machine 1 may further comprise a number inspection system 60 adapted to inspect a quality of the serial numbers (SN1, SN2, SN2', . . . ) provided on the imprints. This number inspection system 60 could consist of a convenient OCR (Optical Character Recognition) system. However, considering that the serial numbers provided on the imprints are dependent on the relevant numbering scheme (N1, N2, N2', . . . ) being carried out by the sheet numbering system 20 (and therefore dependent on the inspection results), it is much more convenient to ensure that inspection of the quality of the serial numbers is carried out in dependence of the operation of the numbering system 20. That is, the numbering system 20 preferably provides information to the number inspection system 60 as to the serial numbers which are expected to be printed onto the imprints and the number inspection system 60 checks that the actual printed serial numbers correspond to the expected numbers, in addition to other quality measurements such as ink smearing or over-/under-inking. Any quality deviation identified by the number inspection system 60 is fed back to the control unit 50 for appropriate sorting of the numbered sheet.

FIG. 10 schematically illustrates an example of a sheet-processing machine combining the functionalities of final inspection and sheet numbering. The illustrated machine is similar to the sheet-processing machines described in International Patent Publications Nos. WO 01/85457 A1, WO 2005/008605 A1 and WO 2005/008606 A1, which are all incorporated herein by reference in their entirety, with the difference that these machines are only designed to number the sheets according to a single predefined numbering scheme.

In the illustrated example, reference numeral 2 designates a sheet-feeder which feeds individual sheets S in succession to an inspection system 10. This inspection system 10 includes in this example three cameras 11, 12, 13, one (e.g. 11) being designed to advantageously perform transmissive inspection of the sheets, while the other two (e.g. 12, 13) are designed to respectively perform reflective inspection of the recto and verso sides of the sheets. Appropriate transport drums or cylinders 15 are provided in order to suitably transport the sheets past and in front of the three cameras 11, 12, 13.

Once inspected, the sheets are transferred via a pair of transfer cylinders or drums (not referenced) to the impression cylinder 25 of a numbering/printing group 3 of the sheet-processing machine 1. This numbering/printing group 3 includes the aforementioned sheet numbering system 20, which here takes the form of two numbering cylinder units each carrying a corresponding set of numbering boxes 21, resp. 22 which are inked by associated inking devices (not shown in FIG. 10).

The number inspection system 60 is embodied in this example as an additional camera system that looks at the printed side of the numbered sheets, while those sheets are still supported by the impression cylinder 25.

A chain conveyor system 4 comprising spaced-apart gripper bars (not shown) ultimately takes the numbered sheets away from the impression cylinder 25 and transports these to the sheet delivery 30, where the sheets are appropriately sorted to corresponding sheet delivery pile units 31, 32, 33, 34. In this example, four sheet delivery pile units 31, 32, 33, 34 are provided. The first sheet delivery pile unit 31 can suitably be used in production for the delivery of entirely good sheets $S^0$ which are numbered according to the aforementioned first numbering scheme N1. The second sheet delivery pile unit 32 can be used for the delivery of the partially defective sheets S' which are numbered according to the aforementioned second numbering scheme N2 or N2'. The third sheet delivery pile unit 33, on the other hand, can be used for the delivery of entirely defective sheets $S^X$ which are not numbered (as well as for the delivery of any test sheets). This is obviously purely illustrative and more than one sheet delivery pile unit may be assigned to one and a same sheet type. For instance, the first and second sheet delivery pile units 31, 32 could be used as production pile units, in an alternate manner, to receive the entirely good sheets $S^0$ numbered in accordance with the first numbering scheme N1, while the third sheet delivery pile unit 33 may be assigned to the partially defective sheets S' and the fourth delivery pile unit 34 used as reject pile unit for the entirely defective sheets $S^X$.

Another embodiment of the invention will now be discussed in reference to FIGS. 8 and 9. This other embodiment provides for the ability to carry out so-called statistical (or sample) process control (SPC) of numbered sheets. In a manner similar to the previous embodiments, numbering of the individual sheets S is selectively commutable between a first numbering scheme and at least a second numbering scheme, different from the first numbering scheme, without interruption of the numbering process. While the first numbering scheme can be the same as the aforementioned numbering scheme N1, the second numbering scheme consists in this example of a special numbering scheme that appropriately identifies numbered sheets that will be the subject of the statistical process control, i.e. sheets that will be sorted out in a special event pile unit (or SPC pile unit) so as to allow an operator to take the sheets out and pass them to a quality control department for more detailed inspection.

Figure 8:
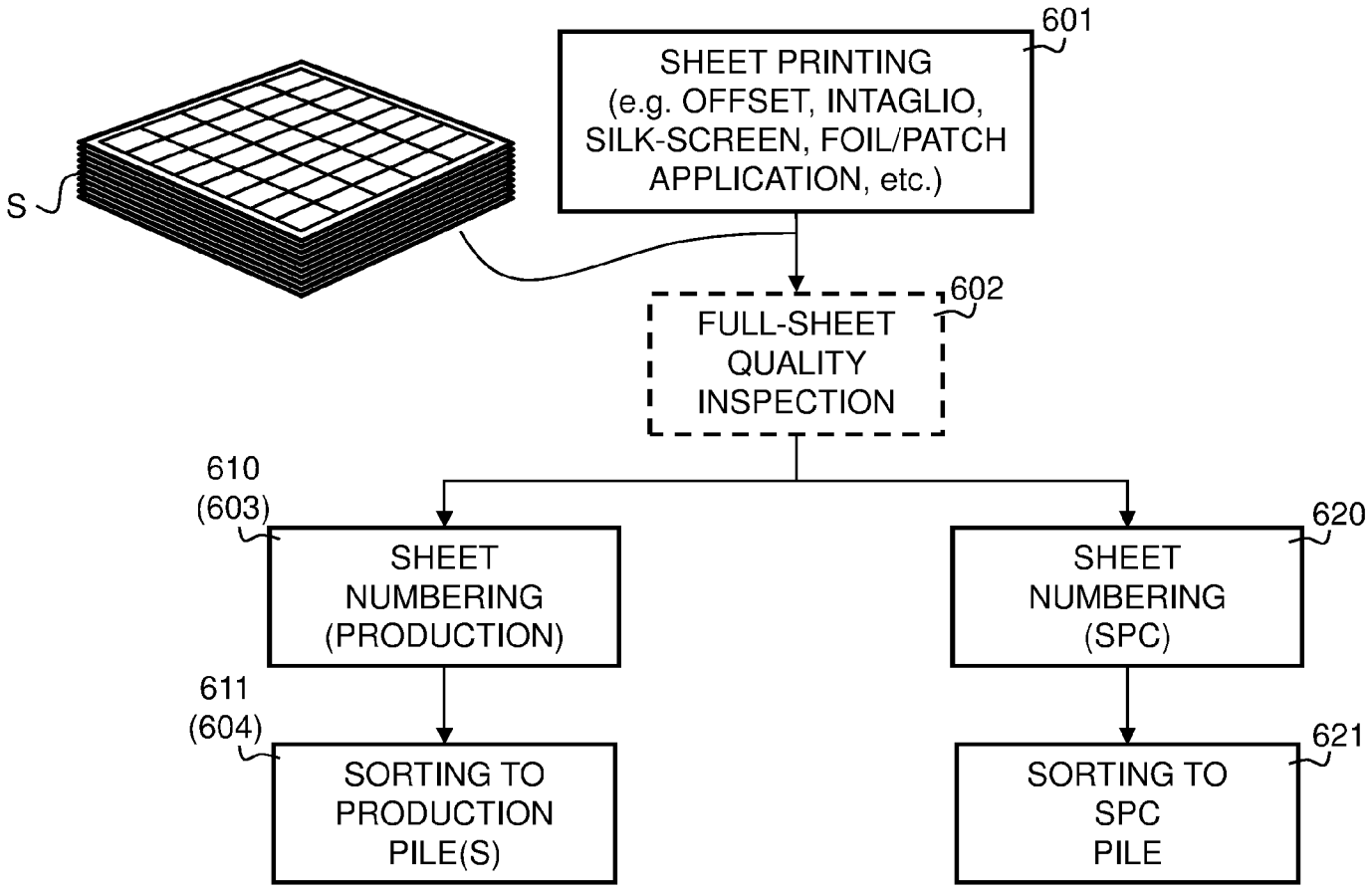
FIG. 8 is a flow chart illustrating an embodiment of the invention as applied in the context of the numbering of sheets for the purpose of carrying out statistical (or sample) process control of the numbered sheets.

In essence, as schematically illustrated by the flow chart of FIG. 8, this process implies the ability to selectively run a separate special numbering scheme on the sheets. Steps 610 and 611 in FIG. 8 could respectively correspond to steps 603 and 604 of FIG. 3, while steps 620, 621 correspond to numbering of the sheets according to the special SPC numbering scheme and subsequent sorting of the thus-numbered sheets to a special event pile unit (such as e.g. sheet delivery pile unit 34 in FIG. 10).

The SPC numbering scheme could be any appropriate numbering scheme which would be differentiable from the numbering scheme used for actual production. As schematically depicted by FIG. 9, this could consists in a numbering scheme having a specific prefix identifier, such as "SP" in the illustrated example.

Figure 9:
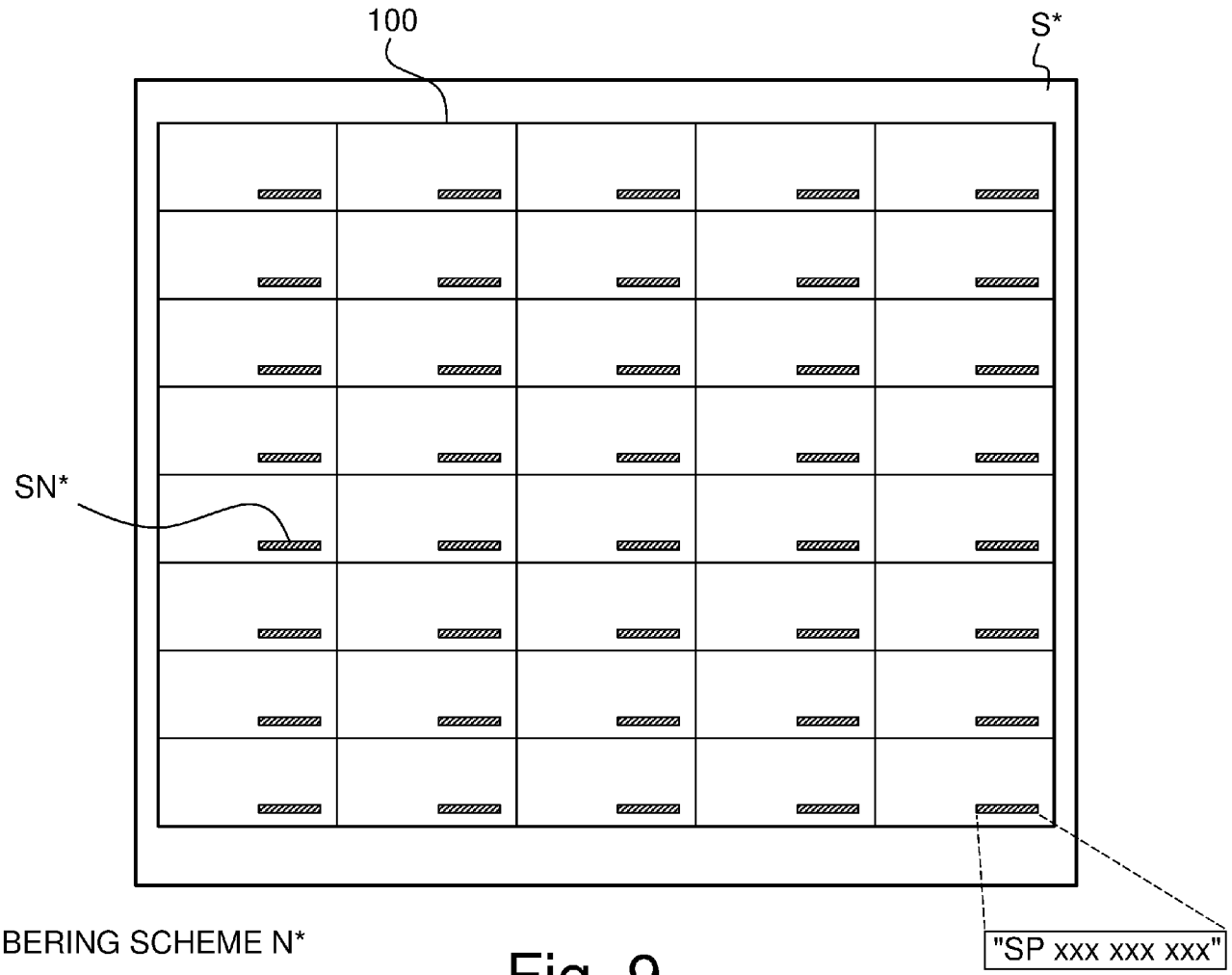
FIG. 9 is a schematic illustration of a sheet which is numbered according to a numbering scheme, which is different from the first numbering scheme, for the purpose of carrying out statistical process control of the numbered sheets.

It is preferable to run the special SPC numbering scheme exclusively on entirely good sheets, which sheets are identified by reference S* in FIG. 9 for the sake of distinction, in which case full-sheet quality inspection is carried out at step 602. In other words, the special SPC numbering scheme could perfectly be implemented as an additional functionality of the numbering process depicted in FIG. 3, i.e. by running the special SPC numbering scheme (steps 620, 621 of FIG. 8) on the entirely good sheets $S^0$, in parallel to steps 603 and 604 of FIG. 3.

The special SPC numbering scheme may alternately run on any type of sheets, even partially defective sheets, but it is more sensible to perform such numbering scheme on entirely good sheets as these are intended to allow more detailed inspection by a quality control department.

In the context of this particular embodiment, full-sheet quality inspection (i.e. step 602 in FIG. 8) is not essential and numbering could be carried out on the sheets S irrespective of their quality. It is therefore to be appreciated that step 602 in FIG. 8 is optional in this particular context.

In the context of this embodiment, it is advantageous to run the special SPC numbering scheme on a periodic basis (for instance every thousand entirely good sheet) so as to perform a representative sampling of the entire production at regular intervals.

Once the detailed inspection has been carried out by the quality control department, the statistical process control sheet(s) S* can be returned to production or destroyed, if required.

It will be apparent that suitable numbering boxes should be used in order to enable the selective commutation between the various numbering schemes. In that respect, partly or, preferably, fully flexible numbering boxes, such as the partly or fully-motorized numbering boxes disclosed in International Patent Publication No. WO 2007/148288 A2 (which is incorporated herein by reference in its entirety), as sold by the Applicant under the product designation NBX®, are highly advantageous.

Various modifications and/or improvements may be made to the above-described embodiments without departing from the scope of the invention as defined by the annexed claims. For instance, in lieu of the partly or fully-motorized numbering boxes mentioned above, one could alternately make use of fully flexible numbering boxes as for instance disclosed in European Patent Publication No. EP 0 718 112 A1.

LIST OF REFERENCE NUMERALS USED THEREIN

S individual (printed) sheets
100 effective printed area of the sheets/matrix arrangement of rows and columns of imprints P
200 note bundle(s) (e.g. banknote bundle(s))
210 pack(s) of note bundles 210
P imprints on effective printed area 100 of the sheets S
$P^0$ inspected imprints P meeting quality requirements/good imprints
$P^X$ inspected imprints P not meeting quality requirements/defective imprints
$S^0$ inspected sheets S carrying only good imprints $P^0$/entirely good sheets
S' inspected sheets S carrying mixture of good imprints $P^0$ and defective imprints $P^X$/partially defective sheets
$S^X$ inspected sheets S carrying only defective imprints $P^X$/entirely defective sheets
N1 (first) numbering scheme
SN1 serial numbers of (first) numbering scheme N1
N2 (second) numbering scheme
SN2 serial numbers of (second) numbering scheme N2
X1 cancellation mark for defective imprint $P^X$ (first example)
X2 cancellation mark for defective imprint $P^X$ (second example)/provided by means of corresponding numbering box
X3 cancellation mark for defective imprint $P^X$ outside of effective printed area 100 (first margin location)
X4 cancellation mark for defective imprint $P^X$ outside of effective printed area 100 (second margin location)
N2' (second) numbering scheme (alternative)
SN2' serial numbers of (second) numbering scheme N2' (alternative)
SNx discarded serial numbers of (second) numbering scheme N2' (alternative)
S* statistical (sample) process control (SPC) sheet
N* (second) numbering scheme/statistical (sample) process control (SPC) numbering scheme
SN* serial numbers of (second) numbering scheme N*
1 sheet-processing machine
2 sheet feeder
3 numbering/printing group
4 chain conveyor system with spaced-apart gripper bars
10 sheet inspection system
11 (first) inspection camera (e.g. for transmissive inspection)
12 (second) inspection camera (e.g. for reflective inspection of the recto side of the sheets S)
13 (third) inspection camera (e.g. for reflective inspection of the verso side of the sheets S)
15 (three) inspection drums or cylinders
20 sheet numbering system
21 (first set of) numbering boxes (e.g. horizontal numbering boxes)
22 (second set of) numbering boxes (e.g. vertical numbering boxes)
25 impression cylinder
30 sheet delivery station
31 (first) sheet delivery pile unit (e.g. production pile unit)
32 (second) sheet delivery pile unit (e.g. production pile unit)
33 (third) sheet delivery pile unit (e.g. reject pile unit)
34 (fourth) sheet delivery pile unit (e.g. statistical process control pile unit)
50 control unit
60 number inspection system

The invention claimed is:

1. A sheet numbering process involving feeding of individual sheets in succession, which individual sheets each carry a plurality of imprints that are arranged in a matrix of rows and columns, and providing unique serial numbers to multiple ones of the plurality of imprints carried by the individual sheets, the sheet numbering process comprising numbering of at least some of the individual sheets, wherein numbering of the individual sheets is selectively commutable between a first numbering scheme and at least a second numbering scheme, different from the first numbering scheme, without interruption of the numbering process, wherein the first numbering scheme involves providing all imprints of a first subset of individual sheets with a unique serial number of the first numbering scheme, wherein the second numbering scheme involves providing all or part of the imprints of a second subset of individual sheets with a unique serial number of the second numbering scheme, and wherein the first subset of individual sheets and the second subset of individual sheets are sorted after numbering in dependence of the numbering scheme.

2. The sheet numbering process according to claim 1, further comprising inspecting a quality of the individual sheets prior to numbering and numbering of at least some of the individual sheets that have been inspected, wherein inspection of the quality of the individual sheets includes differentiating at least between entirely good sheets, where all imprints are good imprints meeting quality requirements, and partially defective sheets where only a part of the imprints are good imprints meeting the quality requirements and a remaining part of the imprints are defective imprints not meeting the quality requirements, wherein the first subset of individual sheets consists of the entirely good sheets and the second subset of individual sheets consists of the partially defective sheets, and wherein the second numbering scheme involves providing only the good imprints of the partially defective sheets with a unique serial number of the second numbering scheme.

3. The sheet numbering process according to claim 2, further comprising the steps of sorting the entirely good sheets which have been numbered according to the first numbering scheme to at least a first sheet delivery pile unit, and of sorting the partially good sheets which have been numbered according to the second numbering scheme to at least a second sheet delivery pile unit.

4. The sheet numbering process according to claim 3, further comprising the step of sorting unnumbered sheets, including test sheets and/or entirely defective sheets, where all imprints are defective imprints, to at least a third delivery pile unit.

5. The sheet numbering process according to claim 2, wherein the defective imprints of the partially defective sheets are each provided with or identifiable by a cancellation mark.

6. The sheet numbering process according to claim 5, wherein numbering of the imprints is carried out by at least one corresponding set of numbering boxes, which numbering boxes are adapted to provide the cancellation mark on the defective imprints.

7. The sheet numbering process according to claim 6, wherein the numbering boxes are partially or fully-motorized numbering boxes.

8. The sheet numbering process according to claim 2, wherein the second numbering scheme is a numbering scheme whereby no serial number is assigned to the defective imprints and the numbering sequence is skipped for each defective imprint.

9. The sheet numbering process according to claim 1, wherein the second subset of individual sheets is numbered for the purpose of statistical process control (SPC), and wherein the second numbering scheme involves providing all of the imprints of the second subset of individual sheets with a unique serial number of the second numbering scheme.

10. The sheet numbering process according to claim 9, wherein the second subset of individual sheets is automatically numbered on a periodic basis and wherein the sheets which have been numbered for the purpose of statistical process control (SPC) are automatically sorted to at least one statistical process control (SPC) pile unit.

11. The sheet numbering process according to claim 1, wherein numbering of the first subset of individual sheets and of the second subset of individual sheets is carried out by at least one and a same set of numbering boxes and wherein the numbering boxes are operated dynamically to perform numbering of the relevant imprints according to the first numbering scheme or according to the at least second numbering scheme.

12. The sheet numbering process according to claim 11, wherein the numbering boxes are partially or fully-motorized numbering boxes.

13. The sheet numbering process according to claim 1, further comprising the step of inspecting a quality of the serial numbers provided on the imprints.

14. The sheet numbering process according to claim 13, wherein inspection of the quality of the serial numbers is carried out on the basis of actual knowledge of the serial numbers that are expected to be provided on the imprints.

15. The sheet numbering process according to claim 1, wherein the first numbering scheme is a numbering scheme allowing non-collating finishing of consecutively-numbered documents.

16. A sheet-processing machine for carrying out of individual sheets, comprising:

a sheet feeding and transporting system adapted to feed and transport individual sheets in succession, which individual sheets each carry a plurality of imprints that are arranged in a matrix of rows and columns;

a numbering system for numbering at least some of the individual sheets, which numbering system is adapted to number a first subset of individual sheets according to a first numbering scheme and at least a second subset of individual sheets according to at least a second numbering scheme, different from the first numbering scheme;

a control unit designed to control operation of the numbering system and to selectively commute operation of the numbering system between the first numbering scheme and the at least second numbering scheme without interruption of the numbering process, and a sheet delivery station where the first subset of individual sheets and the second subset of individual sheets are sorted after numbering in dependence of the numbering scheme, wherein the first numbering scheme involves the provision by the numbering system of a unique serial number on each of all of the imprints of the first subset of individual sheets, and wherein the second numbering scheme involves the provision by the numbering system of a unique serial number on each of all or part of the imprints of the second subset of individual sheets.

17. The sheet-processing machine according to claim 16, further comprising an inspection system located upstream of the numbering system and adapted to inspect the quality of the individual sheets and to differentiate at least between entirely good sheets, where all imprints are good imprints meeting quality requirements, and partially defective sheets, where only a part of the imprints are good imprints meeting the quality requirements and a remaining part of the imprints are defective imprints not meeting the quality requirements, wherein the first subset of individual sheets consists of the entirely good sheets and the second subset of individual sheets consists of the partially defective sheets, and wherein the second numbering scheme involves the provision by the numbering system of a unique serial number only on each of the good imprints of the partially defective sheets.

18. The sheet-processing machine according to claim 16, wherein the second subset of individual sheets is numbered for the purpose of statistical process control (SPC), and wherein the second numbering scheme involves the provision by the numbering system of a unique serial number on each of the imprints of the second subset of individual sheets.

19. The sheet-processing machine according to claim 16, wherein the numbering system comprises partially or fully-motorized numbering boxes.

20. The sheet-processing machine according to claim 16, further comprising a number inspection system adapted to inspect a quality of the serial numbers provided on the imprints.

21. The sheet-processing machine according to claim 20, wherein the number inspection system is adapted to inspect the quality of the serial numbers provided on the imprints in dependence of the operation of the numbering system.

22. The sheet-processing machine according to claim 16, wherein the sheet delivery station includes at least a first delivery pile unit where the first subset of individual sheets which have been numbered according to the first numbering scheme are delivered and at least a second delivery pile unit where the second subset of individual sheets which have been numbered according to the at least second numbering scheme are delivered.

* * * * *